US009839246B2

(12) United States Patent
Weedlun et al.

(10) Patent No.: US 9,839,246 B2
(45) Date of Patent: Dec. 12, 2017

(54) DECORATIVE HEAT-SEALABLE POCKET

(71) Applicants: Paul Weedlun, Ellicott City, MD (US); Patricia A. Mason, White Hall, MD (US); Owen C. McGovern, Rockville, MD (US)

(72) Inventors: Paul Weedlun, Ellicott City, MD (US); Patricia A. Mason, White Hall, MD (US); Owen C. McGovern, Rockville, MD (US)

( * ) Notice: Subject to any disclaimer, the term of this patent is extended or adjusted under 35 U.S.C. 154(b) by 212 days.

(21) Appl. No.: 15/006,685

(22) Filed: Jan. 26, 2016

(65) Prior Publication Data

US 2016/0235145 A1 Aug. 18, 2016

Related U.S. Application Data

(60) Provisional application No. 62/107,950, filed on Jan. 26, 2015.

(51) Int. Cl.
*A41D 27/20* (2006.01)
*A41D 27/08* (2006.01)

(52) U.S. Cl.
CPC ..... *A41D 27/204* (2013.01); *A41D 27/08* (2013.01)

(58) Field of Classification Search
CPC ..... A41D 27/204; A41D 27/08; A41D 27/20; A41D 27/201
See application file for complete search history.

(56) References Cited

U.S. PATENT DOCUMENTS 4,357,197 A * 11/1982 Wilson ..... A41D 27/204 112/470.09
4,365,355 A * 12/1982 Off ..... A41D 27/204 2/247
4,389,801 A 6/1983 Sharrock et al.

* cited by examiner

*Primary Examiner* — Vishal I Patel
(74) *Attorney, Agent, or Firm* — Baker Donelson, PC; Royal W. Craig

(57) ABSTRACT

A decorative pocket applique with a graphical element that can be heat-applied to most any garment to create a functional pocket with aesthetic value. The applique is made of 100% polyester fabric woven or knit which is dye-sublimated-printed to create an exterior decorative image or logo. The applique interior has a perimeter made of a thermoplastic adhesive consisting of either nylon, polyester or some combination thereof that is used to seal a folded top lip or edge of the intended pocket to itself and the remaining perimeter adhesive to a piece of apparel or garment.

20 Claims, 1 Drawing Sheet

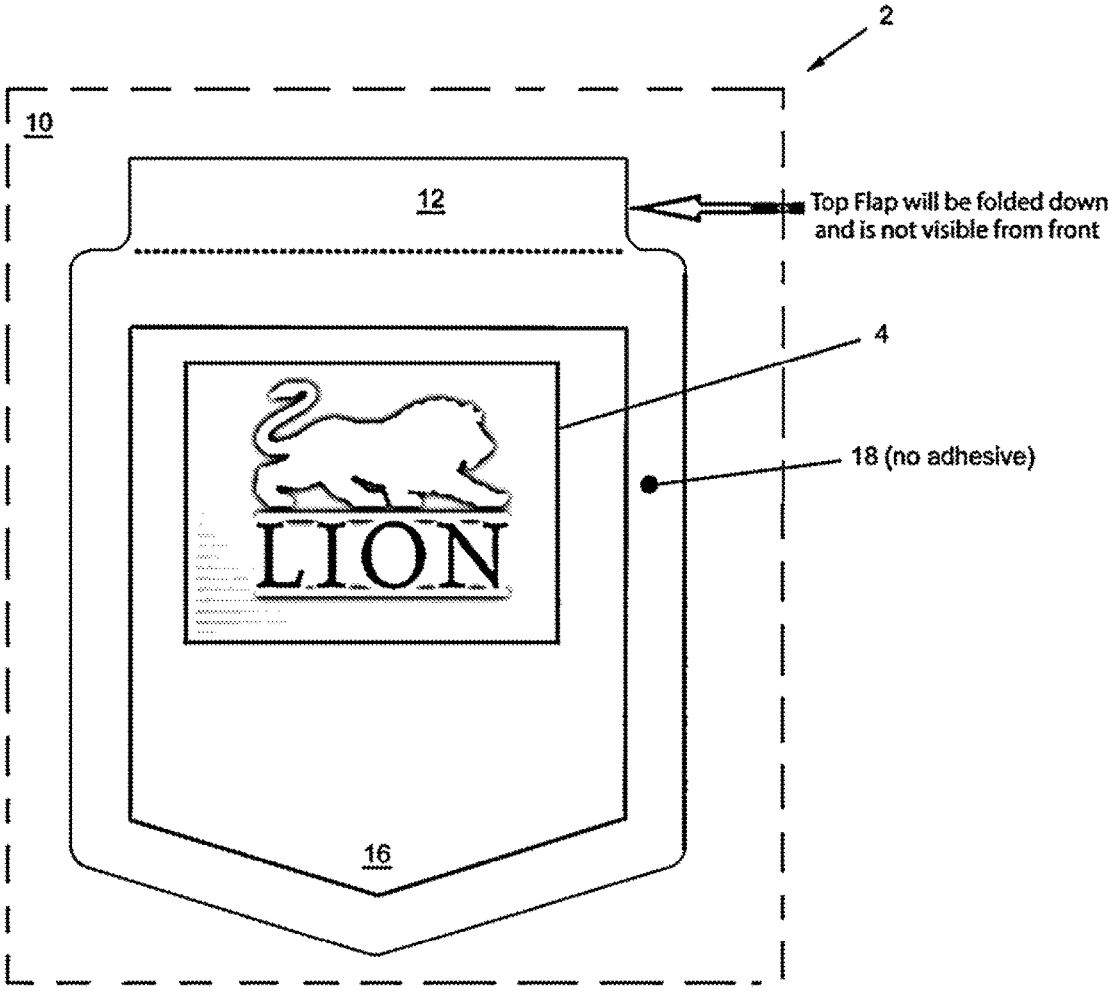
2
10
12
Top Flap will be folded down and is not visible from front
4
18 (no adhesive)
LION
16

DECORATIVE HEAT-SEALABLE POCKET

CROSS-REFERENCE TO RELATED APPLICATIONS

The present application derives priority from U.S. Provisional Application Ser. No. 62/107,950 filed 26 Jan. 2015.

BACKGROUND OF THE INVENTION

1. Field of the Invention

The present invention relates to heat activated transfers and appliqués and, particularly, to a light-weight breathable heat-transfer comprised of numbers, letters, logos, graphics, and other indicia which do not change the physical and visual characteristics of performance fabrics to which they are applied, including breathability, moisture-wicking characteristics, stretch and recovery, and launderability.

2. Description of the Background

Pockets are often found in both formal and casual apparel, are made of various fabrics, and incorporate various closures including buttons or snaps, zippers, hook-and-loop fasteners and similar closures. Pockets are also commonly used for decorative purposes and often bear a monogram, insignia, crest or other decorative logo or graphic. Pockets are also very functional, and are often filled with numerous implements including pens, pocket protectors, cell phones, etc., or are simply used to warm one's hands. These functional applications oftentimes cause pockets to be subjected to an unusually high amount of wear and tear. When items are removed they very often cause a tight pulling sensation and over time the pocket may tear and fray, which negatively affects the overall appearance of the garment they are attached to.

To maximize durability traditional pockets are sewn onto the garment, but the time and materials to sew on a pocket add cost to the manufacturing process. Thermal appliques have been used for ornamentation, but the thermal bond is not considered to be as robust as sewing. Consequently, thermal applique-type pockets have not been used due to the unusually high amount of wear and tear that they would be exposed to and the short anticipated lifetime that would result.

There remains a need for an applique which can create a functional pocket that can be quickly applied to a garment to customize any piece of apparel with a custom graphic or logo. Such a product would increase the value of the garment and/or an individual's affinity for that garment once decorated. A decorative heat-sealable pocket product such as this could be applied to any apparel, even previously-manufactured apparel. The decorative heat-sealable pocket product could be made in the field and/or applied to any garment in the field, in quick response to an event or at a point-of-sale location to customize a garment for a consumer or retailer. The product could even be sold at retail for a consumer to apply to the garment themselves.

U.S. Pat. No. 4,389,801 describes a heat applied pocket intended to create a clear window for insertion of a name or identification tag. It is solid sealed object that has a access opening cut below the top line of the object which allows insertion of a another thin identification element which is viewed through a clear plastic. Unfortunately, the '801 heat applied pocket does not appear or perform like a traditional sewn-in apparel pocket with an open top that is folded over.

It would be greatly advantageous to provide a decorative heat-sealable pocket applique' that can be applied to any garment or textile without obstructing any performance characteristics of the garment or textile, and which is therefore particularly well-suited for lightweight, breathable and/or moisture-wicking textiles commonly used in performance sports apparel.

SUMMARY OF THE INVENTION

It is, therefore, an object of the present invention to provide a decorative heat-sealable pocket applique' that can be applied to any garment or textile without sewing, and yet provide commensurate durability.

It is another object to provide a decorative heat-sealable pocket applique' that does not obstruct existing performance characteristics of the garment or textile, and which is therefore particularly well-suited for lightweight, breathable and/or moisture-wicking textiles commonly used in performance sports apparel.

And it is another object of the present invention to provide a decorative heat-sealable pocket applique' that can be manufactured and installed cost effectively in the field, by retailers and consumers desiring custom ornamentation.

According to the present invention, the above-described and other objects are accomplished, by a decorative pocket applique with a graphical element that can be heat-applied to most any garment to create a functional pocket with aesthetic value. The applique is made of 100% polyester fabric woven or knit which is dye-sublimated-printed to create an exterior decorative image or logo. The applique interior has a perimeter made of a thermoplastic adhesive consisting of either nylon, polyester or some combination thereof that is used to seal a folded top lip or edge of the intended pocket to itself and the remaining perimeter adhesive to a piece of apparel or garment.

In use, the applique would be delivered for application to a garment and would be applied by a heat-press or iron that elevates the temperature of the adhesive and allows it to flow into the garment and create a permanent bond. Various embodiments of the product would allow for a plurality of polyester fabric types including woven and knit structures the most common being square or twill weaves and jersey knits. The use of dye-sublimation printing allows for a nearly infinite variety of graphic or logo options. The sublimation printing provides a durable graphic which can survive the heat application process without degradation of the graphic.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 1 is a front view of a heat-activated decorative pocket appliqué 2 according to an embodiment of the present invention.

DETAILED DESCRIPTION OF THE PREFERRED EMBODIMENT

The present invention is a decorative heat-sealable pocket applique' that can be applied to any garment or textile without sewing, and yet provide equal durability. The design is such that the thermal application does not obstruct existing performance characteristics of the garment or textile, and is therefore particularly well-suited for lightweight, breathable and/or moisture-wicking textiles commonly used in performance sports apparel. Moreover, the pocket can be printed and applied cost-effectively in the field by retailers and consumers desiring custom ornamentation.

FIG. 1 is a front view of a decorative heat-sealable pocket applique' 2 in accordance with an embodiment of the invention.

FIG. 1 shows the basic geometry of the product, which begins with a blank 10 of polyester fabric. The blank 10 is preferably 100% polyester. This is important because polyester can be colored utilizing dye sublimation printing processes which are superior in surviving deformations. Deformation of other synthetics less amenable to dye sublimation can result in sheering of color pigment from the printed product.

The blank 10 is printed with a decorative element 4 onto the upper face of blank 10. The colors of the decorative element 4 are chosen with regard to the color(s) of the blank 10 to contrast or accentuate those color(s). The blank 10 is printed with decorative element 4 using dye sublimation printing, in as many passes as desired to print as many colors as desired. The blank 10 is then cut around decorative element 4. The cut pattern for the blank 10 may vary somewhat but will always have an upwardly extending top margin 12. Top margin 12 rises from any of a variety of common geometric pocket shapes such as pentagonal (shown), or rectangular, rounded-bottom, crest-shaped, etc. as a matter of design choice. The preferred embodiment of heat-sealable pocket applique' 2 for use as a pocket on a shirt would have a cut pattern resulting in a geometric pocket shape of exemplary overall dimensions of 10.5 cm width and overall height of 12 cm.

A subarea 16 of the geometric pocket shape is defined, subarea 16 being substantially the same shape of the geometric pocket shape (exclusive of top margin 12) but smaller to fully enclose decorative element 4 yet leave a marginal region 18 in a border-width or margin within a range of from 0.5-3 cm across, more preferably a 1-2 cm margin, and most preferably a 1 cm margin.

The defined marginal region 18 (again excluding the top margin 12) is coated with a thermoplastic adhesive consisting of either nylon, polyester or some combination thereof leaving the defined subarea 16 as well as the top margin 12 uncoated. This provides a lower lamination border that surrounds and encloses marginal region 18 running below the top margin 12, and underlying the decorative heat-sealable pocket applique' 2 for laminating the appliqué 2 to a garment. The lower lamination border comprises a polyester-compatible heat activated adhesive layer. Suitable thermoplastic adhesives for the present invention include polyurethane adhesives such as Bemis Sewfree™ 3218 ester polyurethane produced by Bemis Associates Inc. or similar adhesives. The lower lamination border preferably has a hot melt point within a range, preferably of from 175-300 degrees F.

In order to apply the decorative heat-sealable pocket applique' 2 to the garment, the applique' 2 is placed atop the garment in the desired position with the top margin 12 folded down and underneath such that it underlies the upper section of marginal region 18 running below the top margin 12 as well as the adhesive thereon. After the top is folded over with an overlap of at least 1.0 cm to 1.6 cm, this double-fold creates a durable pocket-top and prevents the encapsulated adhesive from bonding to the garment, effectively creating an open pocket top with pocket opening about 8.5 cm wide. The decorative heat-sealable pocket applique' 2 is then fused to the garment along three adjoining sides via the exposed lower lamination border by using a heat press with heated platens, iron or the like heated to the hot melt point of from 175-300 degrees F.

The above-specified width of the lower lamination border and the top fold of top margin 12 is designed to prevent easy sheering off of the pocket 2 if a force is exerted on the top edge. Of course, one skilled in the art will understand that deviations of the overall dimensions can occur to accommodate proportional changes in garment sizes or designer preferences; however the adhesive perimeter should stay intact or be proportionally scaled up to maintain performance. It should now be apparent that the foregoing results in a color-printed and/highlighted appliqué 2 as in FIG. 1 that gives a functional pocket having an aesthetically-pleasing color-contrasted appearance in a form that is easily applied to a garment or other textile. The decorative heat-sealable pocket applique' 2 can be applied to any polyester garment or textile without sewing, and still provide equal durability. Such polyester fabric types may include woven and knit structures the most common being square or twill weaves and jersey knits. The use of dye-sublimation printing allows for a nearly infinite variety of graphic or logo options. The sublimation printing provides a durable graphic which can survive the heat application process without degradation of the graphic. The design is such that the thermal application does not obstruct existing performance characteristics of the garment or textile, and is therefore particularly well-suited for lightweight, breathable and/or moisture-wicking textiles commonly used in performance sports apparel. Moreover, all of the printing and cutting may be controlled by common digital files, greatly increasing efficiency, and the pocket can be printed and applied cost-effectively in the field by retailers and consumers desiring custom ornamentation.

This has been a description of the present invention and, the preferred embodiment of the present invention, as well as various alternate embodiments of the present invention.

We claim:

1. A method of manufacturing a thermal pocket applique' that can be heat-applied to any garment or textile, comprising the steps of:

obtaining a fabric blank substantially comprising synthetic polyester;

printing a decorative graphic on one side of said fabric blank by dye sublimation printing;

cutting said fabric blank around said decorative element in a geometric pocket shape having an extending top margin;

coating a lower laminating frame around said cut fabric blank underlying said cut fabric blank with a marginal area outside said decorative graphic, and beneath said extending top margin, leaving said top margin uncoated;

folding said top margin underneath said lower laminating frame; and thermally fusing said thermal pocket applique' to a garment around three contiguous sides via said coated lower laminating frame leaving said folded top margin open in an open-pocket configuration.

2. The method of manufacturing a thermal pocket applique' according to claim 1, wherein said extending top margin comprises a rectangular margin.

3. The method of manufacturing a thermal pocket applique' according to claim 2, wherein a width of said geometric pocket shape exceeds a width of said rectangular margin.

4. The method of manufacturing a thermal pocket applique' according to claim 2, wherein said rectangular margin has a height within a range of from 1.0 cm to 1.6 cm.

5. The method of manufacturing a thermal pocket applique' according to claim 3, wherein said rectangular margin has a width of approximately 8.5 cm.

6. The method of manufacturing a thermal pocket applique' according to claim 2, wherein said step of obtaining a fabric blank further comprises obtaining a 100% polyester blank.

7. The method of manufacturing a thermal pocket applique' according to claim 6, wherein said step of printing comprises dye sublimation printing.

8. The method of manufacturing a thermal pocket applique' according to claim 7, wherein said step of dye sublimation printing comprises printing a plurality of colors in a plurality of passes.

9. The method of manufacturing a thermal pocket applique' according to claim 1, wherein said step of cutting a fabric blank comprises cutting around said decorative element in a geometric pocket shape consisting of any one from among the group of a pentagon, hexagon, rectangle, and crest.

10. The method of manufacturing a thermal pocket applique' according to claim 1, wherein said top margin has a height within a range of from 1.0 cm to 1.6 cm.

11. A method of forming a decorative heat-sealable pocket applique', comprising the steps of:

obtaining a blank of material;

printing a decorative graphic element on one side of said blank; cutting the blank around decorative graphic element in a predetermined cut pattern comprising a geometric pocket shape having a top, bottom and sides, with a margin extended upward above the top of said geometric pocket shape;

coating a defined subarea of said geometric pocket shape on a side opposite said printed side with a thermoplastic adhesive, said defined subarea comprising a marginal ring around said geometric pocket shape;

applying the decorative heat-sealable pocket applique' to a garment by placing the applique' atop the garment with the margin folded underneath so that it underlies the marginal ring below the margin and the adhesive coated thereon, and heat-sealing.

12. The method of forming a decorative heat-sealable pocket applique' according to claim 11, wherein said margin comprises a rectangular margin.

13. The method of forming a decorative heat-sealable pocket applique' according to claim 12, wherein a width of said geometric pocket shape exceeds a width of said rectangular margin.

14. The method of forming a decorative heat-sealable pocket applique' according to claim 12, wherein said rectangular margin has a height within a range of from 1.0 cm to 1.6 cm.

15. The method of forming a decorative heat-sealable pocket applique' according to claim 14 wherein said rectangular margin has a width of approximately 8.5 cm.

16. The method of forming a decorative heat-sealable pocket applique' according to claim 12, wherein said step of obtaining a blank further comprises obtaining a 100% polyester.

17. The method of forming a decorative heat-sealable pocket applique' according to claim 16, wherein said step of printing comprises dye sublimation printing.

18. The method of forming a decorative heat-sealable pocket applique' according to claim 17, wherein said step of dye sublimation printing comprises printing a plurality of colors in a plurality of passes.

19. The method of forming a decorative heat-sealable pocket applique' according to claim 11, wherein said step of cutting the blank comprises cutting around said decorative element in said geometric pocket shape consisting of any one from among the group of a pentagon, hexagon, rectangle, and crest.

20. The method of forming a decorative heat-sealable pocket applique' according to claim 11, wherein said rectangular margin has a height within a range of from 1.0 cm to 1.6 cm.

* * * * *